US005822828A

United States Patent [19]

Berard et al.

[11] Patent Number: 5,822,828

[45] Date of Patent: Oct. 20, 1998

[54] FASTENER FOR LAYERED FLOOR COVERINGS AND METHOD OF FASTENING LAYERS

[75] Inventors: Raymond A. Berard; Claude Edward Terry, both of Kennesaw; Harold F. Adams, Chatsworth, all of Ga.; William A. McDonough, Charlottesville, Va.; Michael Braungart, Suderberg, Germany

[73] Assignees: Interface, Inc., Atlanta, Ga.; McDonough Braungart Design Chemistry, L.L.C., Charlottesville, Va.

[21] Appl. No.: 713,949

[22] Filed: Sep. 13, 1996

[51] Int. Cl.[6] ..... A47G 27/04

[52] U.S. Cl. ..... 16/6; 16/16

[58] Field of Search ..... 16/6, 4, 5, 8, 9, 16/16, 17.1

[56] References Cited

U.S. PATENT DOCUMENTS

| | | | |
|---|---|---|---|
| 406,866 | 7/1889 | Atwater | 16/6 |
| 1,685,362 | 9/1928 | Joseph | 16/6 |
| 1,711,149 | 4/1929 | Joseph | 16/6 |
| 2,367,536 | 1/1945 | Spitzli . | |
| 2,702,919 | 3/1955 | Judge | 16/5 |
| 2,726,419 | 12/1955 | Saks et al. | 16/16 |
| 3,271,217 | 9/1966 | Mapson . | |
| 3,558,384 | 1/1971 | Ronning . | |
| 3,558,385 | 1/1971 | Ronning . | |
| 3,558,386 | 1/1971 | Ronning . | |
| 3,712,845 | 1/1973 | Hartung . | |
| 3,788,941 | 1/1974 | Kupit . | |
| 3,858,269 | 1/1975 | Sutton et al. | 16/16 |
| 4,012,544 | 3/1977 | Richards . | |
| 4,394,006 | 7/1983 | Brumlik | 16/16 |
| 4,489,115 | 12/1984 | Layman et al. . | |
| 4,769,895 | 9/1988 | Parkins . | |
| 4,824,498 | 4/1989 | Goodwin et al. . | |
| 5,096,764 | 3/1992 | Terry et al. . | |
| 5,116,439 | 5/1992 | Raus . | |
| 5,304,410 | 4/1994 | Webster . | |
| 5,422,156 | 6/1995 | Billarant . | |

FOREIGN PATENT DOCUMENTS

| | | | |
|---|---|---|---|
| 2113993 | 8/1983 | United Kingdom | 16/6 |

*Primary Examiner*—Chuck Mah
*Attorney, Agent, or Firm*—Kilpatrick Stockton LLP; John S. Pratt; Michael F. Labbee

[57] ABSTRACT

Mechanical fasteners having parallel barbs extending vertically from a horizontal planar member to secure layers of a floor covering. When interposed between floor covering layers the barbs penetrate and anchor into a floor covering material. When a consumer desires to separate the layers, and to replace or recycle one or all the layers of the floor covering, he can do so readily by pulling the layers apart, and then securing new layers together with the mechanical fastener.

12 Claims, 4 Drawing Sheets

FIG. 3
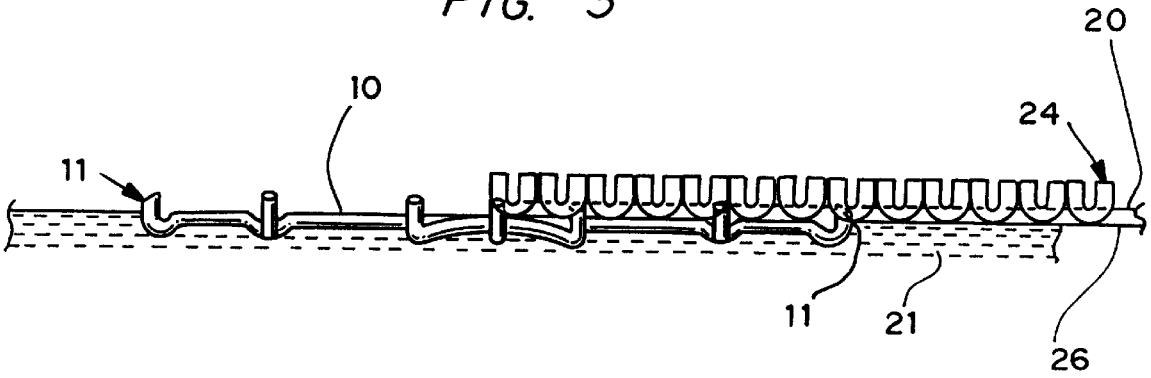
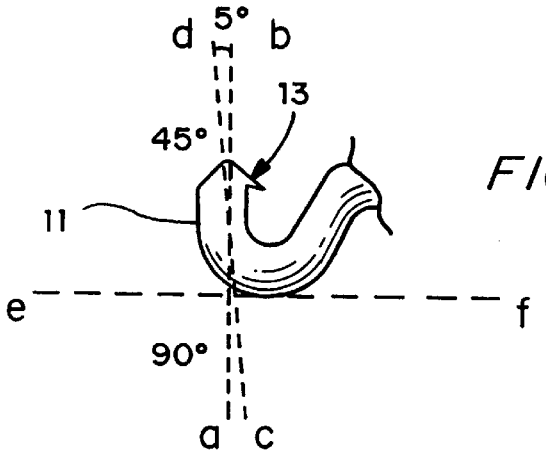
FIG. 4
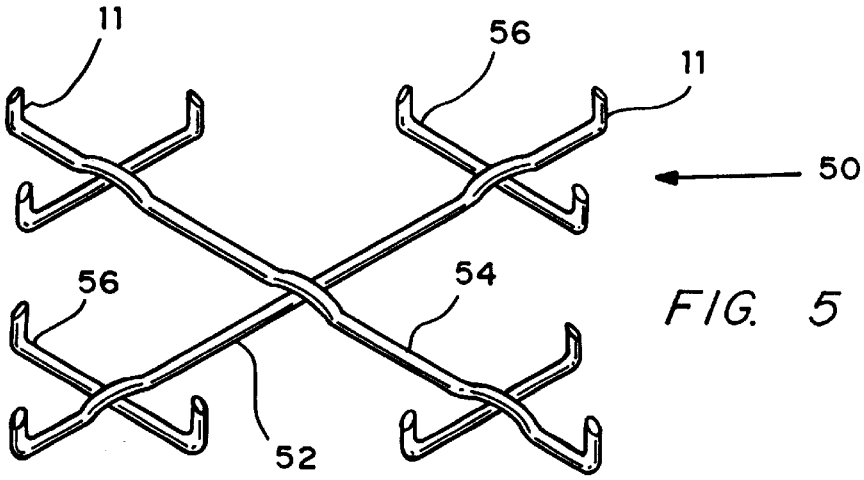
FIG. 5

FASTENER FOR LAYERED FLOOR COVERINGS AND METHOD OF FASTENING LAYERS

FIELD OF THE INVENTION

This invention relates to floor coverings constructed of more than one layer of material, particularly including carpet, and to devices and methods for mechanically securing the layers of such floor coverings together.

BACKGROUND OF THE INVENTION

Manufactured floor coverings are in widespread use in both residential and commercial settings. These floor coverings vary widely, both in the type of material of which the coverings are constructed, and in the manner in which the floor coverings are installed. The exposed surface of many of these floor coverings is constructed either of carpeting or a smooth durable material. Carpeting surfaces can be woven, tufted, fusion bonded or otherwise constructed. Smooth and durable surfacing materials can be derived from virtually innumerable organic, inorganic, man-made, and natural compositions.

Many floor coverings are constructed of one or more layers. These layers often are derived from differing materials, and serve different functional purposes. Most layered floor coverings can be characterized as having two principal layers, a backing layer and a face layer. In turn, the backing and face layers can be comprised of one or more sublayers. As used here, the term "backing" or "backing layer" refers to the layer (including sublayers) of the floor covering that is secured directly to or lies directly against the floor. The term "face layer" refers to the layer (including sublayers) that is positioned on top of the backing, and provides the visible surface of the floor covering after it has been installed.

Floor coverings are often manufactured and packaged in rolls at the factory. To install the floor covering one simply rolls out the floor covering at the installation site, cuts it to size, and, if desired, secures the covering to the floor. Other floor coverings are manufactured as tiles and installed on or secured to a floor as such. Both tile and roll-goods floor coverings can be constructed entirely at the factory with all the layers of the floor covering secured together at the factory. Other floor coverings require that the backing layer first be applied on-site, and that a face layer be applied subsequently to the backing layer.

Chemical adhesives are often used to secure together backing and face layers. Chemical adhesives generally perform well in floor coverings, and provide a durable and intimate bond between floor covering layers. Chemical adhesion is, however, an impediment to separating the face layer from the backing, which often must be done before applying a new face layer to an existing backing, or recycling the layers of the floor covering. Many chemical adhesives provide too much adhesion between the two layers, and prevent later separation at the interface of the layers. Attempts to separate floor coverings into different layers often destroy one of the layers. If the layers are successfully separated, they are most often not separated cleanly.

The prior art discloses several ways to construct layered floor coverings that can be separated into layers after use. Parking, U.S. Pat. No. 4,769,895, discloses interlocking dust control mats. The mats have cleats on the bottom that mate with cleats molded to the top of an interconnecting strip that is laid on the floor. Layman et al., U.S. Pat. No. 4,489,115, discloses two adjacent pieces of artificial turf that are bound together at their edges by a mated surface interlocking fastener such as Velcro™ or 3M Scotchmate™ located on both the bottom of one edge and the top of the other edge. Another means to releasably secure two layers together is disclosed in Goodwin et al., U.S. Pat. No. 4,824,498 and Raws, U.S. Pat. No. 5,116,439. Goodwin and Raws each disclose an additional layer that is incorporated into the floor covering between the face layer and backing layer. The additional layer splits when the face layer and backing layer are pulled apart with part of the additional layer adhering to the top layer, and the other part adhering to the bottom layer.

SUMMARY OF THE INVENTION

The present invention relates to the use of mechanical fasteners to secure together layers of a floor covering. The fasteners, which in one embodiment are interposed between layers of the floor covering, provide a secure and intimate bond between the layers. Separation of the layers is readily accomplished simply by pulling them apart. A new face layer can then be secured to the existing backing, using either the same or new mechanical fasteners.

The fasteners of this invention have parallel barbed prongs that extend vertically from a horizontal planar member. When installed, the barbed prongs penetrate and anchor the fastener to a floor covering material. The length and dimensions of the barbed prongs can be adapted to penetrate into and anchor single or multiple layers. Similarly, the length and dimensions of the barbed prongs can be varied to anchor a particular layer at its optimum depth.

The barbs can extend in either one or both directions from the planar member. When the barbs extend in both directions the fastener can penetrate and anchor two adjacent layers when interposed between them. The fastener can also secure together two layers when the barbs only extend in one direction. For example, by positioning a fastener with barbed prongs behind the backing layer and pressing the face and backing layers onto the fastener, if the barbed prongs are of sufficient length they will penetrate all the way through the backing layer and at least partly into the face layer, and thereby anchor the face layer to the backing layer. Alternatively, a series of fasteners can be laid on the backing layer with all of the barbs in the series of fasteners pointing up. A series of floor tiles can then be laid over the fasteners. The network of fasteners and tiles provides an extended face layer that weighs enough to stay in place and to resist lateral movement.

It is an object to this invention, therefore, to provide a novel mechanical fastener for securing together layers of a floor covering.

It is another object of this invention to provide a mechanical fastener that permits the layers of a floor covering to be separated and reused.

A further object of this invention is to provide a reusable mechanical fastener for floor coverings.

A still further object of this invention is to provide a method to replace the face of a floor covering while reusing an existing backing layer.

Yet another object of this invention is to fashion a network of tiles laid as a flooring face layer over a separate backing.

Other objects, aspects, and advantages of this invention will become apparent upon review of this specification, the accompanying drawings, and the claims.

BRIEF DESCRIPTION OF THE DRAWINGS

FIG. 3 is a side elevation view of the fastener of FIG. 1 shown incorporated into a floor covering.

FIG. 4 is an exploded side view of a barb that is incorporated into the fasteners shown in FIGS. 1 and 5.

FIG. 5 is a top perspective view of an alternative fastener of the present invention.

DETAILED DESCRIPTION OF THE DRAWINGS

Figure 1:
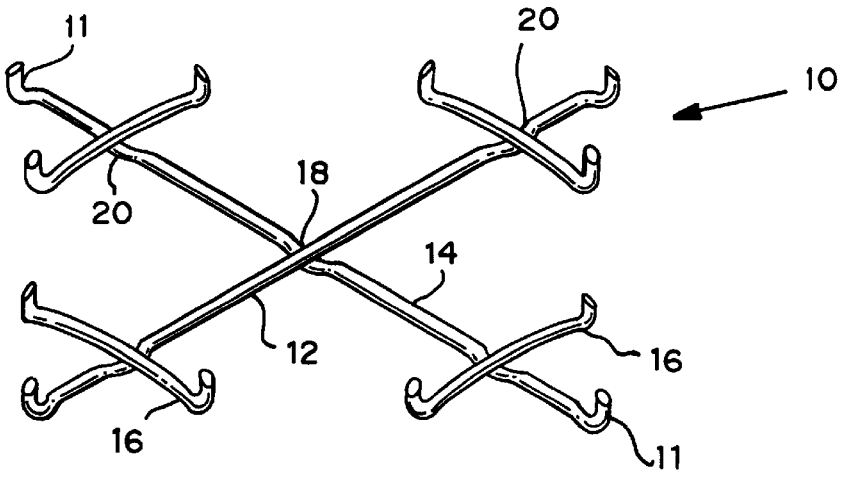
FIG. 1 is a top perspective view of one embodiment of a fastener of the present invention.

FIG. 1 shows a fastener 10 formed from two longer, generally straight rods 12 and 14 joined at their midpoints transversely to each other, and four shorter rods 16, each of which is joined at its midpoint to either rod 12 or rod 14 near the ends of rods 12 and 14 so that each rod 16 generally is transverse to the rod 12 or 14 to which it is joined. Although rod 12 overlies rod 14 and each shorter rod 16 overlies the rod to which it is attached, all of rods 12, 14 and 16 generally lie in the same plane as a result of the relatively small diameter of the rods and the deviations of the rods at the joints. Specifically, a bend 18 in the form of an inverted arch in rod 14 receives overlying rod 12, so that most of the lengths of rods 12 and 14 lie in the same plane. Similarly, bends 20 in rods 12 and 14 are in the form of inverted arches, receive overlying rods 16, and allow rods 16 to lie generally in the same plane as rods 12 and 14. Because bends 18 and 20 extend to a substantially uniform depth beneath the plane in which the rods lie, fastener 10 lays flat when laid upon a flat surface, and numerous uniformly distributed points of support are provided to the fastener.

Rods 12, 14 and 16 are also bent so that the ends of each of the rods descend to a substantially uniform depth below the plane in which the rods generally lie before bending back up to form a prong 11 that extends substantially normal to the plane. The ends of rods 12 and 14 bend descendingly to form one side of an inverted arch, with the prong extending upward along the opposing side of the arch. Rods 16 descend from the point at which they are joined to rods 12 and 14 at a slope that increases uniformly along the descent. Prongs 11 extend upward from the point at which the descent terminates.

The depth of the bends at the ends of rods 12, 14, and 16 is substantially equal to the depth of bends 18 and 20. Because the depth is substantially similar to the depth of bends 18 and 20, the fastener lies flat, and additional support is provided to the fastener when laid upon a flat surface. The depth of the bends at the ends of the rods also enhances the retention of a floor covering layer by the fastener, by effectively lengthening the barbed prongs without increasing their height above the plane within which the rods generally lie, and thereby allowing the barbed prongs to penetrate more deeply into a layer of compressible material than the height of the barbed prongs above the plane would otherwise allow.

The ends of rods 12, 14 and 16 are bent to extend substantially normal to the plane within which the rods generally lie, to substantially the same height above the plane for uniform penetration of the prongs into a layered floor covering. The tips at the ends of rods 12, 14, and 16 are sharpened and shaped to form a prong from which a backward projecting point, or barb, extends to prevent the fastener from being easily extracted from a layer into which the ends of the rods have been inserted. Although many configurations for the barbed prong are possible and within the scope of this invention, a suitable configuration for use with fastener 10 is illustrated in FIG. 4 and designated by numeral 11. A backwardly extending barb is designated by numeral 13.

In a suitable embodiment of fastener 10 prong 11 does not extend at a precise 90 deg. angle from the plane in which the rods generally lie, but is instead tilted slightly away from fastener 10. This tilt is shown in FIG. 4 by lines a-b and c-d. Line a-b extends at a precise right angle to the plane along which the rods generally lie. Prong 11, however, extends along line c-d, which is about 5 degrees from vertical line a-b, and about 95 degrees from the segment of line e-f that connects the base of the two barbed prongs of the rod. The prongs may be tilted about 5 degrees from vertical, away from fastener 10, so that when tiles are pressed onto the fastener they migrate slightly toward the fastener, causing the tiles to press against each other and to form an intimate bond at their edges.

Figure 2:
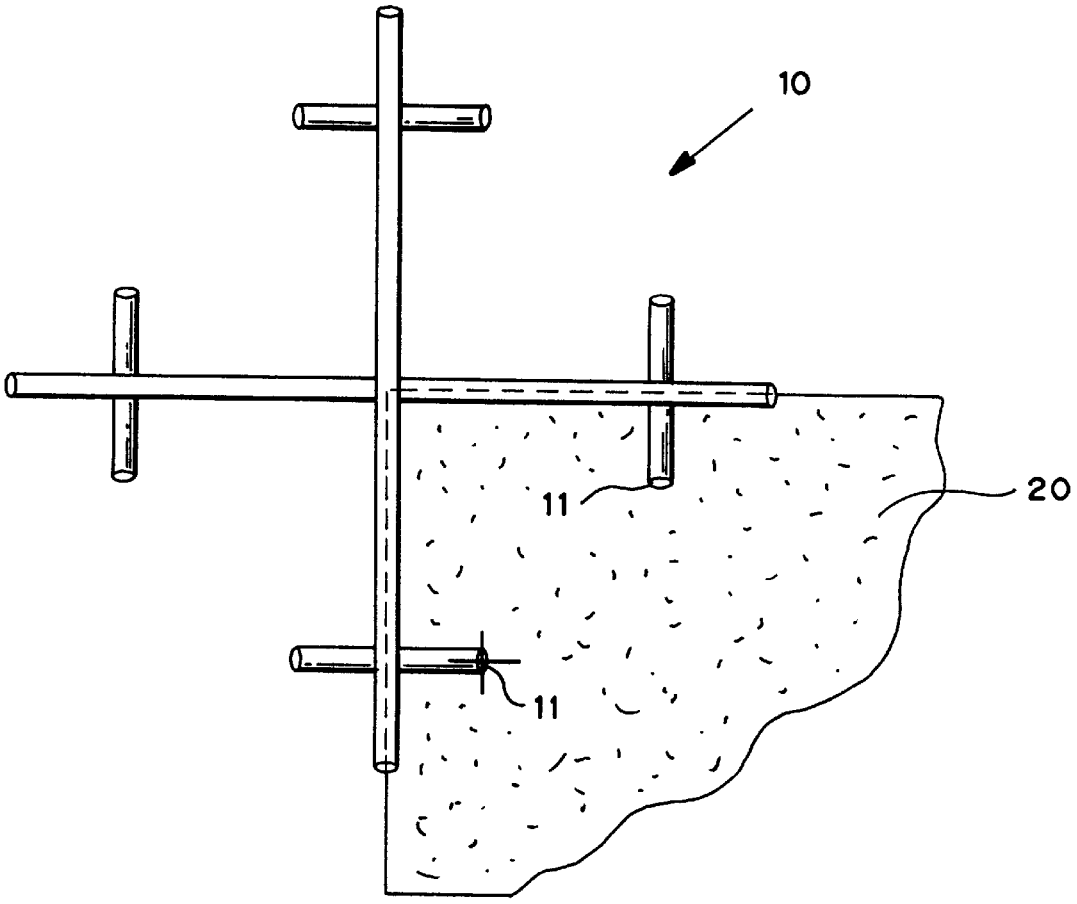
FIG. 2 is a top plan view of the fasteners of FIGS. 1 and 5, showing the position of the fastener relative to a carpet tile.

A suitable use for fastener 10 is shown in FIGS. 2 and 3. FIG. 2 shows a top view of fastener 10 with the corner portion of a carpet tile 20 laid over it. The fastener is positioned to receive the corners of four separate tiles, and to anchor the tiles together along adjacent edges. Two of the barbed prongs 11 anchor the fastener to carpet tile 20. Six other barbed prongs 11 from fastener 10 similarly would anchor three other tiles to the fastener to bind together the four tiles. By securing a plurality of fasteners to the four corners of each of the tiles in the face of a floor covering, the tiles become interlocked and form a cohesive unit that resists movement.

FIG. 3 is a side elevational view of fastener 10 interposed between backing layer 21 and carpet tile 20. FIG. 3 shows that carpet tile 20 comprises part of the face layer of a floor covering. Carpet tile 20 is comprised of a cloth face 24 bonded into a primary backing sheet 26. The barbed prongs 11 extend upwardly into the carpet tile, where the barbs can engage either the cloth face 24 or the primary backing sheet 26, and thereby anchor fastener 10 to the carpet tile 20.

Backing layer 21 is suitably comprised of any compressible material that deforms to accept fastener 10, and thus to allow carpet tile 20 to lay flush with backing layer 21 despite the interposition of fastener 10. Most floor covering backing layers are compressible and thus may suitably be used with fastener 10. Other backing layers are less compressible, and are applied to the floor in a liquid or molten form. In this type of backing layer it may be preferable to press the fastener into the backing layer before the backing layer hardens.

In the embodiment shown in FIG. 3 fastener 10 does not have any barbs extending downward that could penetrate backing layer 21 and anchor the fastener and floor covering to the backing layer. Fasteners could, of course, be constructed with barbs extending in both directions, and such fasteners would be within the scope of this invention. Such a construction is not necessary for fastener 10, however, because the fastener can hold a face layer in place even without having barbs that penetrate the backing layer. In constructions such as shown in FIG. 3, for example, the weight and rigidity of the floor covering tiles, when interconnected through fasteners in a network, is sufficient to hold the floor covering in place. Moreover, as the fastener becomes lodged in the backing layer, the floor covering is further inhibited from moving laterally.

When a consumer wishes to replace carpet tile 20 she simply pulls the carpet tile up, ensures that a fastener is properly positioned on top of the backing layer, and presses a new carpet tile onto the fastener and into the void left by carpet tile 20. A consumer can similarly replace the entire face layer of a floor covering by removing all the carpet tiles, repositioning the existing fasteners or laying a new set of fasteners over the backing layer, and applying the new set of carpet tiles.

Figure 6:
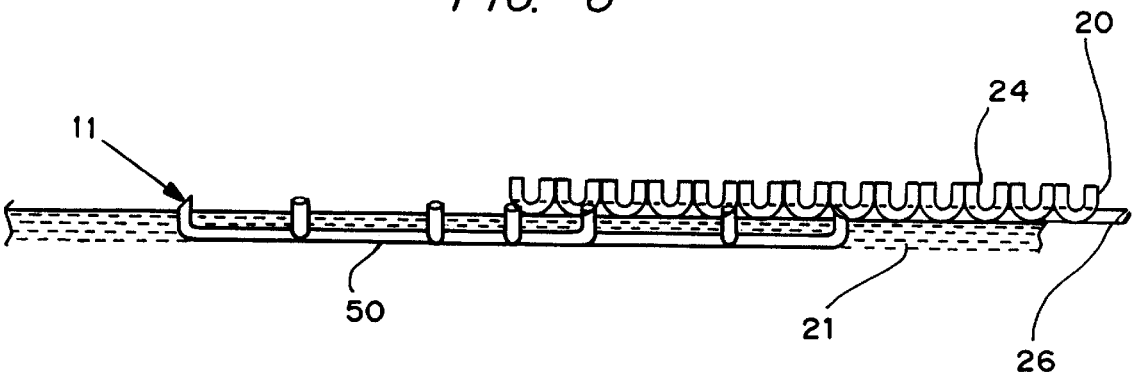
FIG. 6 is a side elevation view of the fastener of FIG. 5 shown incorporated into a floor covering.

FIGS. 5 and 6 illustrate an alternative fastener 50 and a different way to utilize fasteners of the present invention to secure layers of floor covering together. Like fastener 20, fastener 50 is formed from two longer generally straight rods 52 and 54 transversely joined at their midpoints, and four shorter rods 56, one of each being joined at its midpoint near each of the ends of rods 52 and 54 so that each rod 56 is generally perpendicular to the rod 52 or 54 to which it is joined. The rods that comprise fastener 50 generally lie in the same plane because of the small diameter of the rods and the deviations in the joints where the rods are joined. Specifically, at the joinder of rods 52 and 54, rod 54 bends over rod 52 in the form of an arch. Similarly, rods 52 and 54 bend over each of rods 56 at the point at which these rods join. The ends of each of the rods all bend up to extend substantially vertically away from the plane in which the rods generally lie, and to substantially the same height above the plane. The end of each of the rods terminates in the form of a barbed prong, similar to that shown in FIG. 4, optionally at the angle illustrated in FIG. 4.

A suitable use for fastener 50 is shown in FIG. 6, wherein fastener 50 is laid flat against a floor beneath backing layer 21, with the barbed prongs penetrating backing layer 21 and extending through backing layer 21 into face layer 20. The face layer thereby is anchored to fastener 50, which in turn anchors together the backing and face layers. Backing layer 21 preferably is comprised of a material that deforms to accept fastener 50, in order that backing layer 21 is not pushed upward by the fastener to create an uneven surface for the floor covering. The bends in rods 52, 54, and 56 preferably extend upward rather than downward so that the backing layer more readily deforms to accept the fastener.

It will be understood that many configurations of fastener comprised of rods may be suitable for use in this invention. The geometrical relationship between the rods, the shapes of the rods, the lengths of the rods, and the manner in which the rods are secured, all may be varied. As has been shown with fasteners 10 and 50, the rods that make up the fasteners can be joined in several ways. If arches are employed at the juncture of the rods such arches can extend in various directions depending partly upon the use to which the fastener will be put. Arches could even be eliminated if desired. Moreover, the rods may be constructed of any strong and rigid material, either natural or synthetic, including metals and metal alloys, and may be fastened together by any suitable fastening means, including brazing, welding, or chemical adhesion. Each such configuration and variation that carries out the purposes of this invention falls within the scope of the invention.

Figure 7:
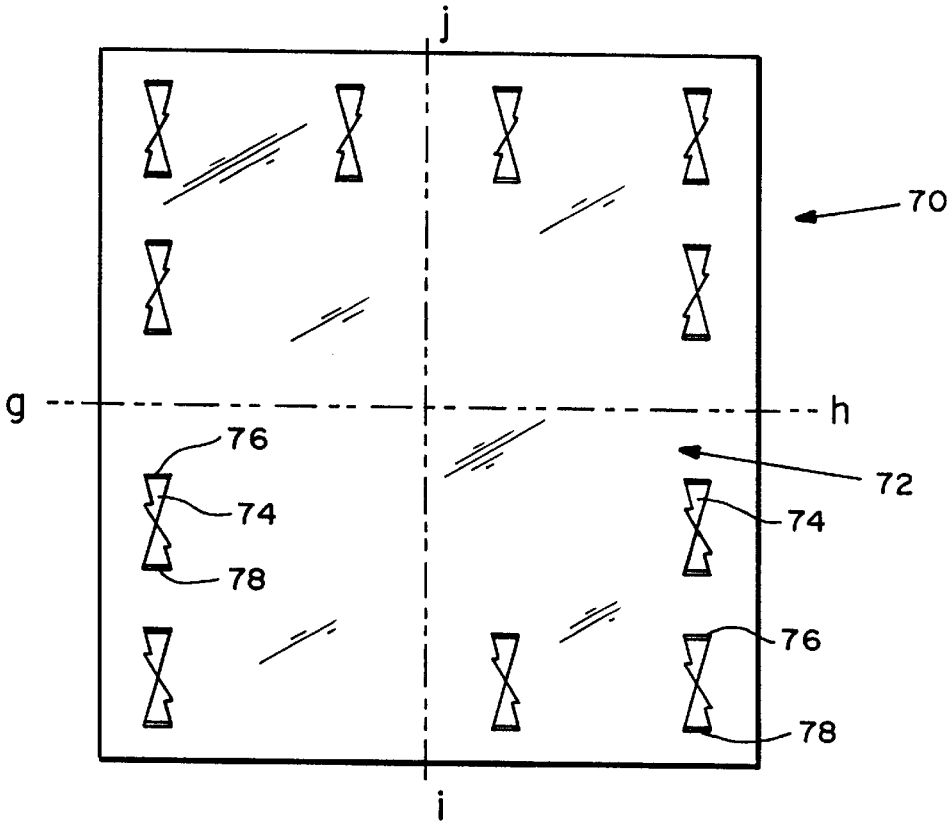
FIG. 7 is a top plan view of another alternative fastener of the present invention.
Figure 9:
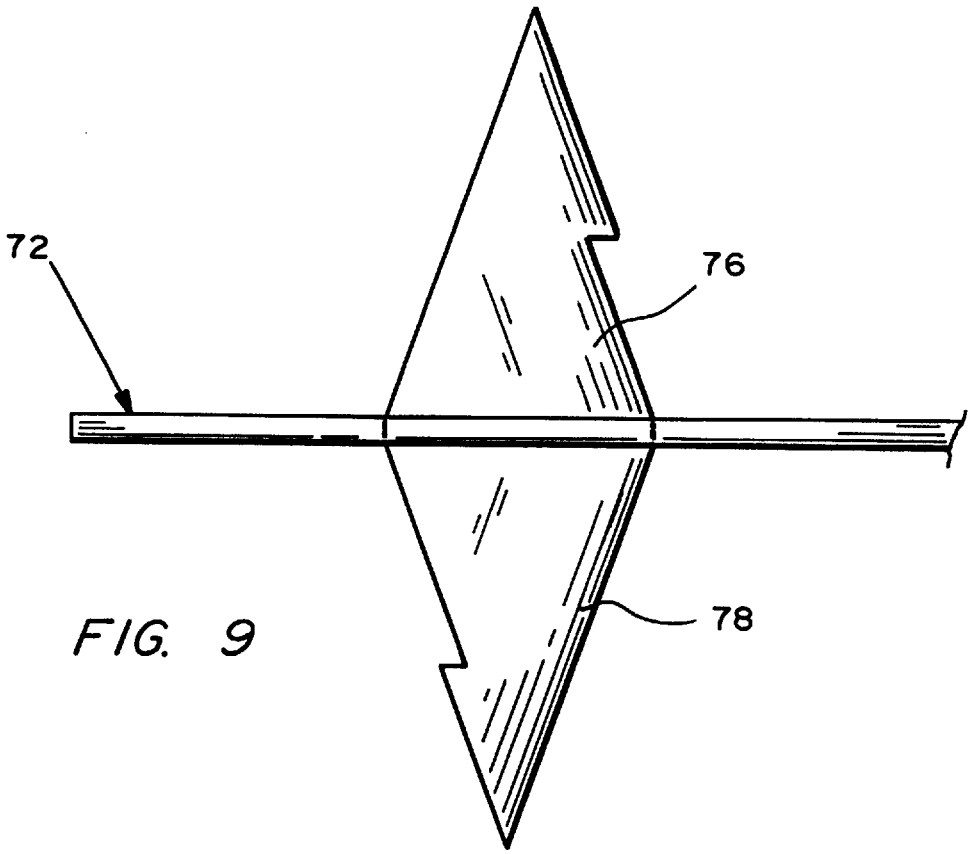
FIG. 9 is an enlarged side elevation view of a barb that is incorporated into the fastener shown in FIG. 7.
Figure 8:
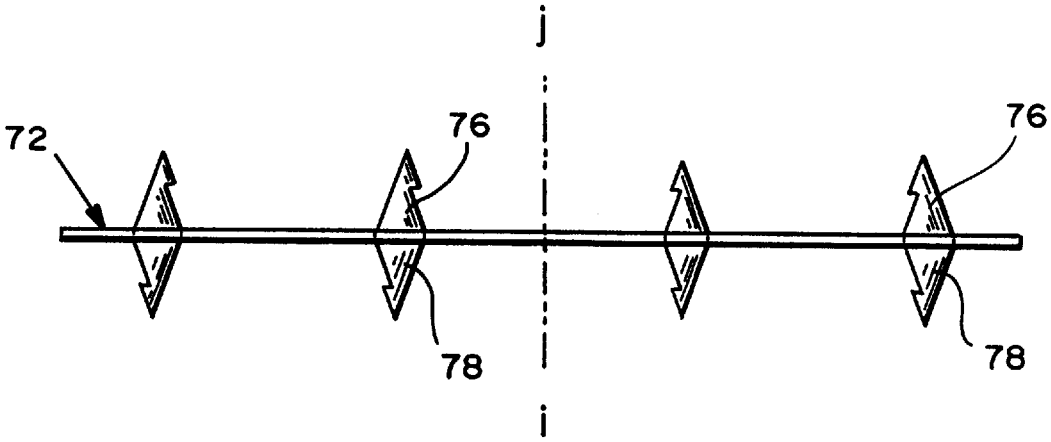
FIG. 8 is a side elevation view of the fastener of FIG. 7.

FIG. 7 is a top plan view of fastener 70, a third fastener constructed according to the present invention. Fastener 70 comprises a sheet 72 that further comprises a plurality of voids 74 and barbed triangular prongs 76 and 78. FIG. 8 is a side elevation view of fastener 70 showing in further detail the structure of prongs 76 and 78, and the relationship of prongs 76 and 78 to sheet 72. FIG. 9 is an enlarged side view of prongs 76 and 78.

Barbed triangular prongs 76 and 78 extend from and line the periphery of opposing sides of sheet 72. The bases of prongs 76 and 78 coincide with sheet 72, and are separated along sheet 72 by voids 74. Each of barbed prongs 76 and 78 is shaped generally as a barbed isosceles triangle with its base opposed to the vertex, and the barb extending backwardly from the vertex. Voids 74 resemble prongs 76 and 78 placed vertex to vertex and aligned in diametric opposition.

The complementary shapes of voids 74 and prongs 76 and 78 are the result of the manufacturing process by which fastener 70 may be produced. In a suitable manufacturing process a malleable sheet of metal 72 is introduced to a punch press, whereupon prongs 76 and 78 are partly severed from sheet 72 and pushed outwardly in opposing directions to rotate around the unsevered bases of prongs 76 and 78 until extended substantially normal to sheet 72. It will be recognized, of course, that other methods to construct fasteners can be employed, such as casting, and that materials other than metals and metal alloys can be used to construct the fasteners.

In use fastener 70 is interposed between backing and face layers of a floor covering, and the layers are pressed together so that prongs 76 and 78 penetrate and anchor the face and backing layers together. The number of fasteners interposed between a face and backing layer can be varied depending on the area of coverage of the floor covering and the degree of adhesion between layers that is desired. A series of carpet tiles may be applied as the face layer over a backing layer, in which case four of the carpet tiles would preferably be applied to each of the fasteners, with the corners of the carpet tiles corresponding generally to the quadrants defined by lines g-h and i-j. If carpet tiles are applied as the face layer it may also be preferable to place the fastener so that prongs 76 penetrate the face layer. Because the barbs from prongs 76 extend inwardly toward line i-j, and are thus closest to the juncture between adjoining carpet tiles when the floor covering is installed, prongs 76 best inhibit a carpet tile from inadvertently separating from a backing layer at the edges of the carpet tile.

The foregoing is provided for purposes of illustrating, explaining, and describing embodiments of the present invention. Modifications and adaptations to theses embodiments will be apparent to those skilled in the art and may be made without departing from the scope and spirit of this invention.

What is claimed is:

1. A fastener used to secure together backing and facing layers of a floor covering, comprising a plurality of interconnected wires arranged in a plane, wherein the ends of the wires are bent to form rigid barbed prongs which extend substantially vertically from the plane and are of a length such that when the fastener is positioned on a top surface of the backing layer, all of the barbed prongs extend into, but not through, the facing layer.

2. The fastener of claim 1 wherein the barbed prongs extend upwards and downwards from both sides of the plane and are of a length such that when the fastener is positioned on a top surface of the backing layer, all of the upwards facing barbed prongs extend into, but not through, the facing layer and all of the downward facing barbed prongs extend into, but not through, the backing layer.

3. The fastener of claim 1 wherein the barbed prongs are of a length such that when the fastener is positioned on a bottom surface of the backing layer, all of the barbed prongs extend through the backing layer and into, but not through, the facing layer.

4. A fastener used to secure together layers of floor covering, comprising:

1. a plurality of substantially linear members disposed along a plane, wherein the plurality of substantially linear members comprises two base members, each having a midpoint and two ends regions, that are:
   (a) substantially the same length;
   (b) secured together at their midpoints;
   (c) perpendicular; and
2. a plurality of interconnected rigid barbed prongs extending from the ends of the linear members in a direction substantially vertically from only one side of the plane.

5. The fastener of claim 4 wherein the plurality of substantially linear members further comprises four ancillary members, each having a midpoint, that are:

(a) substantially the same length;

(b) secured at their midpoints to the four end regions of the two base members; and (c) perpendicular to the base member to which each is secured.

6. The fastener of claim 5 wherein (1) at the points where the linear members are secured together, one of the linear members is bent to form an inverted arch to receive the other member, (2) the ancillary linear members arc through inverted archers bent into the base linear members, and (3) the ends of the base members are bent to form inverted arches from which the barbed prongs extend.

7. The fastener of claim 5 wherein, at the points where the linear members are secured together, one of the linear members is bent to form an upright arch to receive the other member.

8. A method for fastening together two or more layers of floor covering resting on a floor comprising the step of pressing a first layer onto a fastener that is juxtaposed against or within a second layer such that no portion of the fastener extends through the second layer into the floor, wherein the fastener is comprised of a plurality of interconnected wires, the ends of which are bent upward to form rigid barbed prongs that extend toward the first layer, whereby the barbs penetrate and anchor themselves to the first layer but do not extend through the first layer.

9. The method of claim 8 wherein the first layer is comprised of a series of contiguous tiles and a series of fasteners that are juxtaposed against or within the second layer, comprising the additional step of positioning the fasteners so that at least two tiles are pressed onto each fastener.

10. The method of claim 8 comprising the additional step of securing the fastener to the second layer.

11. The method of claim 10 wherein the fastener comprises barbs extending toward the second layer, and wherein the fastener is secured to the second layer by pressing the fastener against the second layer.

12. The method of claim 10 wherein the fastener is secured to the second layer by laying the first layer over the fastener.

* * * * *